US006863497B2

(12) United States Patent
Seydel et al.

(10) Patent No.: US 6,863,497 B2
(45) Date of Patent: Mar. 8, 2005

(54) STATOR VANE SPAN ATTACHMENT FOR A GAS TURBINE

(75) Inventors: Christian Seydel, Stahnsdorf (DE); Andrej Golowin, Berlin (DE)

(73) Assignee: Rolls-Royce Deutschland Ltd & Co KG, Dahlewitz (DE)

( * ) Notice: Subject to any disclaimer, the term of this patent is extended or adjusted under 35 U.S.C. 154(b) by 43 days.

(21) Appl. No.: 10/403,054

(22) Filed: Apr. 1, 2003

(65) Prior Publication Data

US 2003/0185683 A1 Oct. 2, 2003

(30) Foreign Application Priority Data

Apr. 2, 2002 (DE) ..... 102 14 569

(51) Int. Cl.[7] ..... F03B 11/00
(52) U.S. Cl. ..... 415/189; 415/190; 415/209.2
(58) Field of Search ..... 415/189, 190, 415/209.2, 209.3, 209.4, 210.1, 191; 29/889.21, 889.22

(56) References Cited

U.S. PATENT DOCUMENTS 2,857,093 A * 10/1958 Warnken ..... 415/209.3
6,296,443 B1 10/2001 Newman et al. ..... 415/209.2

FOREIGN PATENT DOCUMENTS

| | | |
|---|---|---|
| DE | 2152365 | 8/1972 |
| DE | 2165529 | 7/1973 |
| DE | 2643285 | 3/1978 |

* cited by examiner

*Primary Examiner*—F. Daniel Lopez
*Assistant Examiner*—Dwayne White
(74) *Attorney, Agent, or Firm*—Harbin King & Klima

(57) ABSTRACT

A stator vane span attachment for a gas turbine having a casing 1 in which several stator vane spans 2 are located, wherein means 3 are provided for restraining the stator vane spans 2 against the casing 1.

21 Claims, 3 Drawing Sheets

STATOR VANE SPAN ATTACHMENT FOR A GAS TURBINE

This application claims priority to German Patent Application DE10214569.5 filed Apr. 2, 2002, the entirety of which is incorporated by reference herein.

BACKGROUND OF THE INVENTION

This invention relates to a stator vane span attachment for a gas turbine featuring a casing on which several stator vane spans are located.

Stator vanes of gas turbines are usually designed in the form of segments which are inserted in or fixed to a casing. Designs of the said type are shown in Specification U.S. Pat. No. 6,296,443 B1 by way of example.

The individual vane spans inserted in or attached to a casing must be supported in such a manner that they are retained in the axial direction of the aero gas turbine and in the circumferential direction of the casing. For this purpose, the vane spans possess, for example, legs or grooves which make the applicable positive fit with the casing, as mentioned in the above US Specification. During operation of the stator vane spans in a compressor, high mechanical loads and temperature changes are encountered which can affect the fits used for attachment. Vibrations can in this case occur, giving rise to the development of undesired noise and impairing the mechanical strength of the stator vane spans and their supports.

BRIEF SUMMARY OF THE INVENTION

In a broad aspect, the present invention provides an attachment for the stator vane spans of a gas turbine which is simply designed and cost-effectively producible while avoiding the disadvantages of the state of the art and providing a dependable method of fixing the stator vane spans.

It is a particular object of the present invention to provide solution to the above problems by the combination of the features described herein, with further objects and advantages of the present invention becoming apparent from the description below.

Accordingly, the present invention provides means for restraining the stator vane segments against the casing of the gas turbine or the casing of the compressor, respectively.

The stator vane span attachment according to the present invention is characterized by a variety of merits.

The underlying principle of the present invention is to restrain the stator vane spans against the casing. In this process, the stator vane spans will be subjected to minor deformation. Likewise, the casing can also be deformed correspondingly. This intentionally produced elastic deformation eliminates tolerances or play in the attaching means. Undesired vibrations or similar occurrences are thus avoided completely or at least suppressed significantly. Further, the design according to the present invention provides that the respective free ends of the stator vane spans firmly abut onto the casing and, therefore, do not separate from the casing.

In a particularly favorable development of the present invention, the means for restraining the stator vane spans are situated in the central circumferential area of the spans. This arrangement ensures symmetry of load.

The means for restraining the stator vane spans preferably comprise a setting element which, in a favorable form of the present invention, can be designed as a bolt. This bolt can, for example, be located in a threaded hole of the casing. The bolt is then designed as a tension bolt, for example. Alternatively, pressure bolts, other threaded fasteners or other restraining mechanisms can be employed.

In order to increase the restraining effect, it can be particularly advantageous if the radius of the casing in the area of the stator vane spans is smaller than the radius of the respective stator vane segment. This provides that the free end areas of the stator vane spans abut onto the casing and can be restrained accordingly.

BRIEF DESCRIPTION OF THE DRAWINGS

This invention is more fully described in the light of the accompanying drawings showing a preferred embodiment. In the drawings.

DETAILED DESCRIPTION OF THE INVENTION

This detailed description should be read in conjunction with the summary above, which is incorporated by reference in this section.

Figure 1:
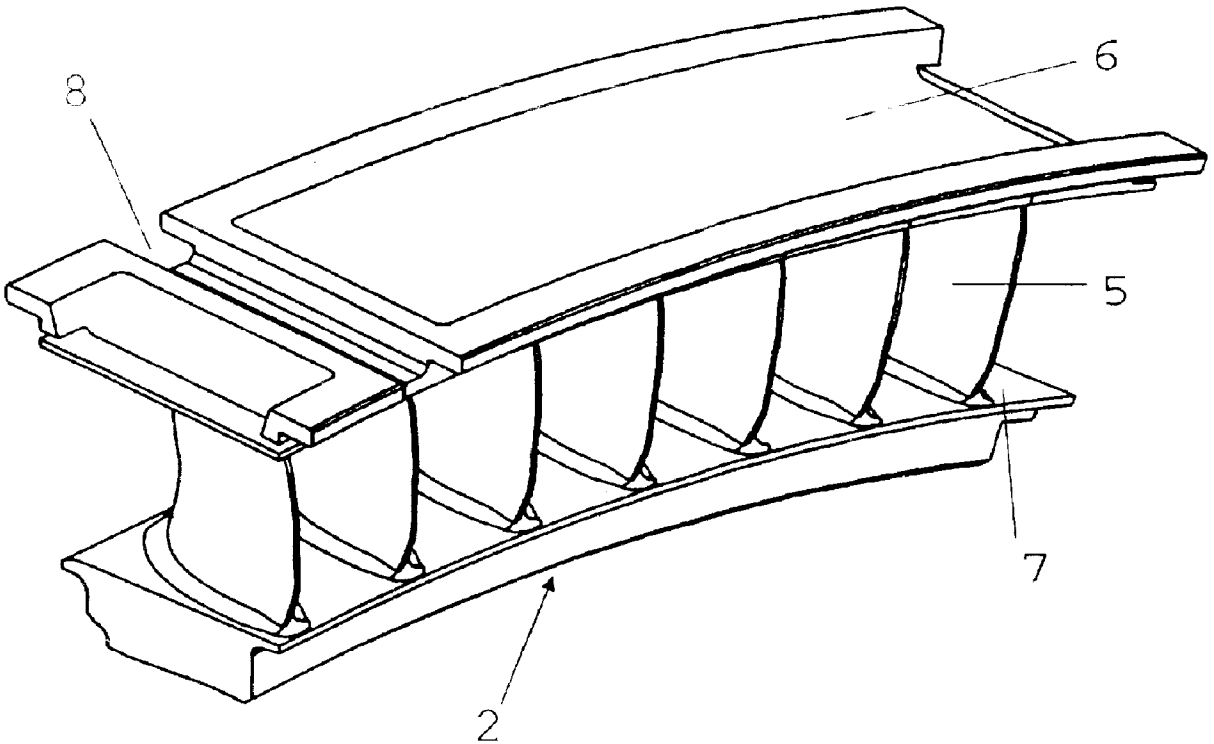
Fig.1 (Prior Art)
FIG. 1 is a schematic representation of a possible form of a stator vane span according to the state of the art.

FIG. 1 shows, in perspective representation, a stator vane span, as it is known per se from the state of the art. The span comprises several stator vanes 5 which connect to a segmental outer support 6 and, optionally, to a segmental inner support 7. The outer support 6 and the inner support 7 can possess lateral legs or tangs or grooves, as applicable, to enable their attachment to a casing 1 (see FIG. 3) or to an inner shroud. These designs are known from the state of the art to which reference is herewith made. Rotation of the stator vane spans 2 in the casing can be avoided by so-called vane stops. For this purpose, the stator vane span shown in FIG. 1 features, for example, a groove 8.

Figure 2:
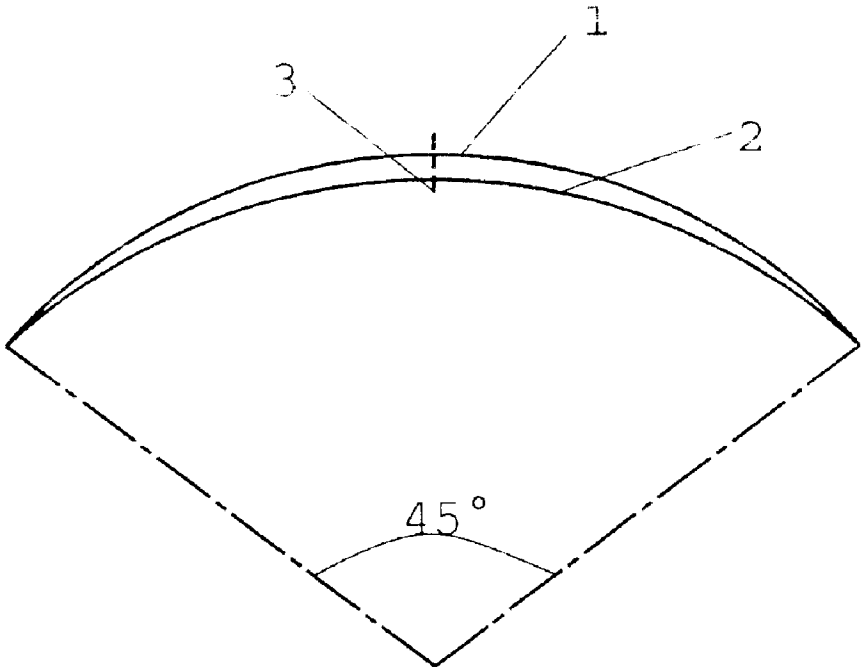
FIG. 2 is a schematic representation of the principle of function underlying the present invention.

FIG. 2 shows, in schematic side view, the principle of function of the present invention prior to restraining. The outer circular arc represents a casing 1, while the inner circular arc indicates a stator vane span 2. Reference numeral 3 indicates the restraining means. As becomes apparent from FIG. 2, the free ends of the stator vane span 2 abut on, or are pressed against, the casing 1 under the strain applied, with a space being formed in the center area.

As strain is further applied, this space will be reduced and the radii deformed to match each other.

FIG. 2 shows that the radius of the stator vane span 2, in the unrestrained condition, is larger than the corresponding radius of the casing 1.

Figure 3:
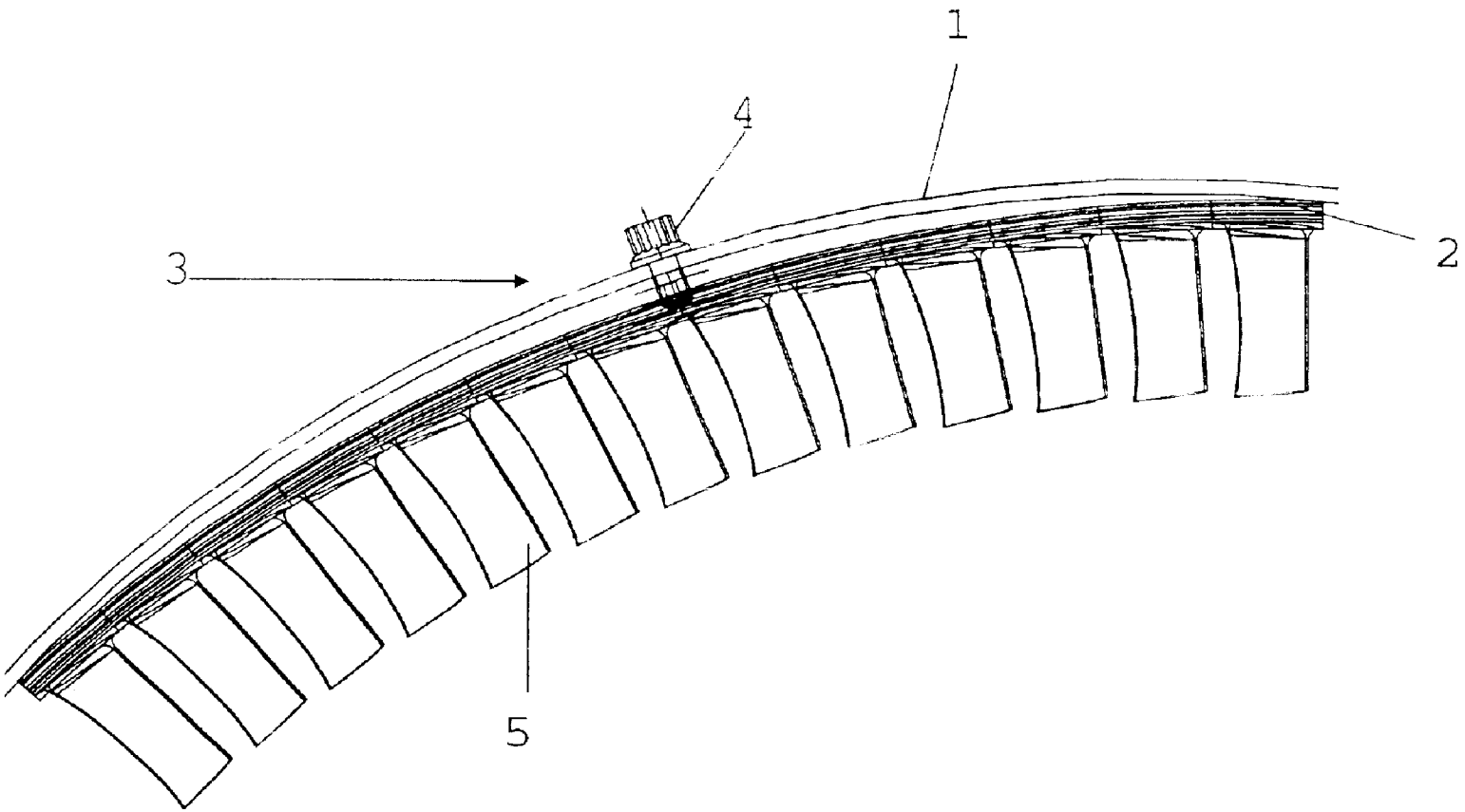
FIG. 3 is a partial side view of a casing area and a stator vane span with means for restraining the stator vane span in accordance with the present invention.

FIG. 3 is a simplified side view in the unrestrained state, in which the restraining means 3 are designed as a bolt 4 which is located in a threaded hole (not detailed) of the casing 1. The bolt is, for example, designed as a tension bolt to deform the stator vane span 2 in the manner described.

In an alternative embodiment of the present invention, the radius of the stator vane span 2 can be smaller than the corresponding radius of the casing 1 and two restraining means 3 can be used on the outer ends of the stator vane span 2 to attach the stator vane span 2 to the casing 1 and conform the stator vane span 2 to the shape of the casing 1.

It is apparent that modifications other than described herein may be made to the embodiment of this invention without departing from the inventive concept.

What is claimed is:

1. A stator vane span attachment for a gas turbine having a casing in which several stator vane spans are positioned, wherein, means are provided for restraining each of the stator vane spans against the casing and the restraining means produces a deformation of each stator vane span.

2. A stator vane span attachment in accordance with claim 1, wherein, the restraining means is positioned in a central circumferential area of the stator vane span.

3. A stator vane span attachment in accordance with claim 2, wherein, the restraining means comprises a setting element.

4. A stator vane span attachment in accordance with claim 3, wherein, the setting element comprises a bolt.

5. A stator vane span attachment in accordance with claim 4, wherein, the bolt is engaged with a threaded hole of the casing and is designed as a tension bolt.

6. A stator vane span attachment in accordance with claim 5, wherein, in an undeformed state, a radius of the casing in an area of the stator vane spans is smaller than a radius of the respective stator vane span.

7. A stator vane span attachment in accordance with claim 1, wherein, in an undeformed state, a radius of the casing in an area of the stator vane spans is larger than a radius of the respective stator vane span.

8. A stator vane span attachment in accordance with claim 1, wherein, the restraining means is positioned in a central circumferential area of the stator vane span.

9. A stator vane span attachment in accordance with claim 1, wherein, the restraining means comprises a setting element.

10. A stator vane span attachment in accordance with claim 9, wherein, the setting clement comprises a bolt.

11. A stator vane span attachment in accordance with claim 10, wherein, the bolt is engaged with a threaded hole of the casing and is designed as a tension bolt.

12. A stator vane span attachment in accordance with claim 1, wherein, in an undeformed state, a radius of the casing in an area of the stator vane spans is smaller than a radius of the respective stator vane span.

13. A stator vane attachment mechanism for a gas turbine, comprising:

a casing;

at least one stator vane span; and at least one restraining means for attaching the stator vane span to the casing;

wherein, in a relaxed state, a radius of the stator vane span is different from a corresponding radius of the casing in an area of attachment of the stator vane span to the casing and the restraining means in a tightened state deforms at least one of the casing and the stator vane span to decrease the difference in the radii of the casing and the stator vane span.

14. A stator vane attachment mechanism as in claim 13, wherein, in the relaxed state, the radius of the stator vane span is larger than the corresponding radius of the casing.

15. A stator vane attachment mechanism as in claim 14, wherein, the restraining means comprises a threaded fastener for engaging the casing.

16. A stator vane attachment mechanism as in claim 15, comprising a plurality stator vane spans and a plurality of restraining means for attaching the plurality of stator vane spans to the casing.

17. A stator vane attachment mechanism as in claim 13, wherein, in the relaxed state, the radius of the stator vane span is smaller than the corresponding radius of the casing.

18. A stator vane attachment mechanism as in claim 14, wherein, the restraining means comprises a dreaded fastener for engaging the casing.

19. A stator vane attachment mechanism as in claim 15, comprising a plurality stator vane spans and a plurality of restraining means for attaching the plurality of stator vane spans to the casing.

20. A stator vane span attachment for a gas turbine having a casing in which several stator vane spans arc positioned, wherein, means are provided for restraining each of the stator vane spans against the casing, wherein, in an undeformed state, a radius of the casing in an area of the stator vane spans is larger than a radius of the respective stator vane span.

21. A stator vane span attachment for a gas turbine having a casing in which several stator vane spans are positioned, wherein, means are provided for restraining each of the stator vane spans against the casing, wherein, in an undeformed state, a radius of the casing in an pea of the stator vane spans is smaller than a radius of the respective stator vane span.

* * * * *